US006465145B1

(12) United States Patent
Yamauchi

(10) Patent No.: US 6,465,145 B1
(45) Date of Patent: Oct. 15, 2002

(54) YELLOW DEVELOPING AGENT

(75) Inventor: Toshiaki Yamauchi, Fujisawa (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/876,084

(22) Filed: Jun. 8, 2001

(51) Int. Cl.[7] ..... G03G 9/08
(52) U.S. Cl. ..... 430/108.23; 430/108.8; 430/109.3
(58) Field of Search ..... 430/108.23, 109.3, 430/108.8

(56) References Cited

U.S. PATENT DOCUMENTS 5,843,605 A * 12/1998 Anno et al. ..... 430/45
6,022,659 A 2/2000 Kanbayashi et al. ..... 430/106
6,106,986 A * 8/2000 Shirai et al. ..... 430/106
6,127,081 A 10/2000 Yamauchi ..... 430/110
6,136,491 A 10/2000 Yamauchi ..... 430/110
6,183,928 B1 * 2/2001 Sata et al. ..... 430/110
6,287,742 B1 * 9/2001 Yoon ..... 430/137.19

FOREIGN PATENT DOCUMENTS

JP 11-237765 8/1999
JP 2000-199982 7/2000

OTHER PUBLICATIONS

The Society of Polymer Science; Nov. 29, 2000; pp. 224–226.

* cited by examiner

*Primary Examiner*—Mark Chapman
(74) *Attorney, Agent, or Firm*—Foley & Lardner

(57) ABSTRACT

Disclosed is a yellow developing agent with improvements in resistance to the environment, the transparency, the resistance to offset, and the safety in the environment, comprising a binder resin containing mainly a copolymer resin of a norbornene derivative and an ethylene derivative, a natural wax, and a yellow coloring material containing mainly benzimidazolone pigment.

14 Claims, 2 Drawing Sheets

YELLOW DEVELOPING AGENT

BACKGROUND OF THE INVENTION

The present invention relates to a developing agent used in an image forming apparatus such as an electrostatic recording apparatus and an electro-photographic apparatus, particularly, to a yellow developing agent used for forming a full color image.

The binder resin used in general in a developing agent includes, for example, a thermoplastic resins such as polystyrene, styrene-acryl copolymer, styrene-butadiene copolymer, polyester resin, polyester-styrene-acryl hybrid resin, epoxy resin, and polyether polyol resin. These binder resins are designed such that the melt viscosity is lowered as required by the heating in the fixing step, an elasticity is maintained under high temperatures in order to prevent the offset, and that the binder resins have a glass transition point higher than the storage temperature so as to prevent a lump of the toner from being generated during the storage.

However, since each of the thermoplastic resins has a polar group, it is possible for the thermoplastic resin to have a slight absorption in near ultraviolet wavelength region. Also, since a partial crystal is present in the resin, the light transmitted through the resin is scattered, with the result that the light transmittance of the resin itself is not sufficiently high. What should also be noted is that the ratios and the molecular weight distribution of the monomers are adjusted for adjusting the thermal characteristics. However, the degree of freedom of the design for satisfying each of these characteristics is not necessarily high.

The color developing agent used for forming a full color image is required to have a sufficient transparency in order to permit the color development to be satisfactory when the developing agents of various colors are superposed one upon the other. Also, as a means for improving the transparency, it is necessary to improve the transparency and the dispersion capability of the materials themselves. At the same time, it is required to obtain a uniform fixed surface low in roughness in order to suppress the reflection from the surface of the formed image.

Under the circumstances, it is unsuitable to use resin that is colored or poor in transparency under the influence of the crystallinity as the binder resin of the color developing agent. The melting characteristics of the resin are also important in selecting the binder resin of the color developing agent.

Such being the situation, it was customary to use, for example, a polyester resin having a low molecular weight, which tends to be subjected to a sharp melt, and low in degree of coloring as the binder resin for a color developing agent. However, the polyester resin is not sufficiently satisfactory in terms of the transparency. Also, the polyester resin has many functional groups and, thus, is not sufficiently satisfactory in the environmental stability, and gives rise to the problem in terms of the life of the color developing agent that the charging amount tends to be fluctuated. In addition, the polyester resin is low in its elasticity in the melting step so as to give rise to the problem that the offset tends to be generated.

As a measure against the offset, generally employed is a method of coating the fixing roller with an oil. However, the oil coating method gives rise to the problems that the machine used is rendered bulky, that it is necessary to replenish the oil periodically, and that the formed image is stained with the oil and is rendered rough. Under the circumstances, various measures are taken not to use an oil.

For example, it is possible to improve the resistance to the offset properties by using a resin having a high elasticity. In this case, however, the image is rendered mat tone so as to impair the color development and the permeability through an OHP. Therefore, in order to maintain the glossiness and the transparency, proposed is a method of, for example, dispersing a wax in a sharp melt resin.

A wax having a low melting point is used in order to permit the wax to be melted even under a low fixing temperature so as to exhibit mold release characteristics. Known waxes meeting the particular requirement include, for example, natural waxes such as carnauba wax and rice wax as well as fatty acid ester wax, fatty acid amide and paraffin wax. These waxes certainly have a melting point lower than that of PP, PE waxes widely used in a monochromatic toner, but tend to give rise to a poor dispersion to be rendered poor. These waxes give rise to the problems that, if the wax fails to be dispersed uniformly, the transparency of the toner is lowered so as to render the color tone poor and, if the dispersion is excessively fine, it is impossible to obtain a sufficient resistance to the offset problems. Also, if a wax is simply dispersed in the resin of the ordinary gloss specification, it was difficult to obtain a sufficient resistance to offset. Further, since the wax has a low melting point, problems tend to be generated if a wax is added to the resin. For example, the storage characteristics and the life characteristics of the developing agent tend to be rendered poor.

In order to improve the transparency of the material itself, it is important for the pigment to be dispersed uniformly in the binder. In order to prevent the pigment particles from being agglomerated within the developing agent, employed can be a master batch method, in which a master batch is prepared in advance by dispersing large amount of pigment particles in a small amount of the binder resin, followed by adding the master batch thus prepared to the binder resin.

The master batch method noted above is certainly effective. It should be noted in this connection that the chemical affinity between the binder resin and the pigment is related basically to the dispersion capability of the pigment particles in the developing agent. Particularly, yellow is a base color for forming various colors, and a yellow developing agent is required to exhibit a sufficient transparency. However, the yellow pigment in particular fails to exhibit a sufficiently high chemical affinity with the general-purpose binder resin, resulting in failure to obtain a sufficient dispersion.

Benzidine yellow, which is a generally used yellow pigment, is one of diazo series metal free pigments.

Benzidine yellow is satisfactory in transparency and coloring power and is relatively satisfactory in its chemical affinity with the binder resin. However, the decomposed material of benzidine yellow is harmful and is designated as a cancinogenic substance in the Blue Angel Mark, which is a safety standard in Germany. Therefore, it is undesirable to use benzidine yellow in view of the environmental contamination. Such being the situation, it is desirable to develop a yellow developing agent utilizing a safe yellow pigment replacing benzidine yellow.

BRIEF SUMMARY OF THE INVENTION

An object of the present invention is to obtain a yellow developing agent, which is safe in view of the environmental contamination, has a high transparency, is satisfactory in the color reproducibility and the resistance to the offset problem, and exhibits a high stability in the resistance to the environmental problem and the life.

Another object of the present invention is to provide a color image forming apparatus capable of forming a high quality color image by using a yellow developing agent, which is safe in view of the environmental contamination, has a high transparency, is satisfactory in the color reproducibility and the resistance to the offset problem, and exhibits a high stability in the resistance to the environmental problem and the life.

According to a first aspect of the present invention, there is provided a yellow developing agent, comprising a binder resin containing mainly a copolymer resin between a norbornene derivative and an ethylene derivative, a natural wax, and a yellow coloring material containing mainly benzimidazolone pigment.

According to a second aspect of the present invention, there is provided a full color image forming apparatus, comprising at least one image carrier, a plurality of developing devices arranged to face the image carriers, and a fixing device, wherein one of the plural developing devices houses a yellow developing agent, comprising a binder resin containing mainly a copolymer resin between a norbornene derivative and an ethylene derivative, a natural wax, and a yellow coloring material containing mainly benzimidazolone pigment.

In the present invention, a copolymer resin of a norbornene derivative and an ethylene derivative, the copolymer resin being transparent and low in polarity, is used as the binder resin. A natural wax is dispersed in the binder resin, and a benzimidazolone pigment is used as a yellow pigment that is safe in terms of the environmental problem so as to obtain a yellow developing agent having the wax dispersed therein satisfactorily, excellent in transparency, and satisfactory in the environmental characteristics and the life characteristics.

Additional objects and advantages of the invention will be set forth in the description which follows, and in part will be obvious from the description, or may be learned by practice of the present invention. The objects and advantages of the present invention may be realized and obtained by means of the instrumentalities and combinations particularly pointed out hereinafter.

BRIEF DESCRIPTION OF THE SEVERAL VIEWS OF THE DRAWING

The accompanying drawing, which are incorporated in and constitute a part of the specification, illustrate presently preferred embodiments of the present invention, and together with the general description given above and the detailed description of the preferred embodiments given below, serve to explain the principles of the present invention.

DETAILED DESCRIPTION OF THE INVENTION

Figure 1:
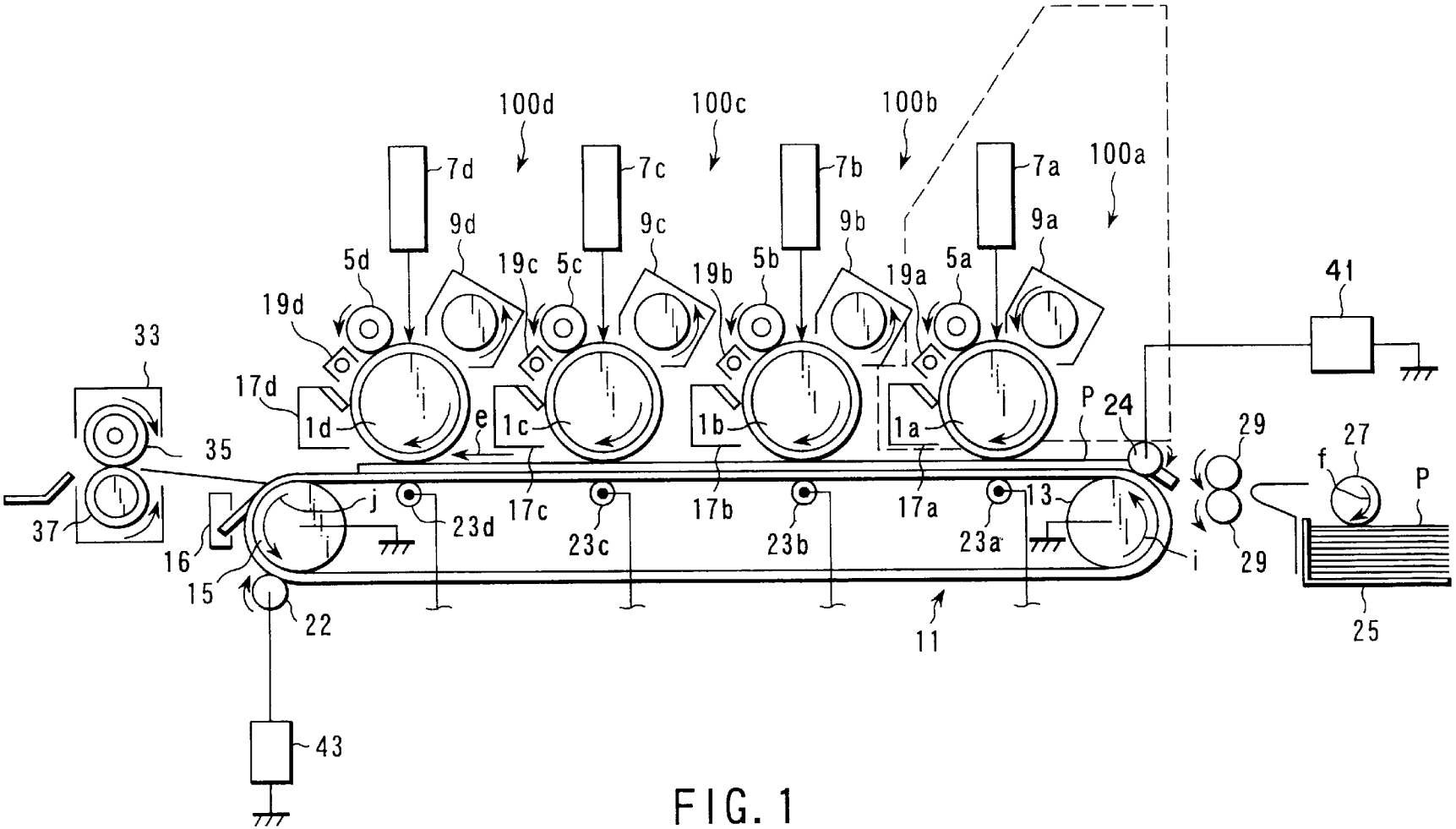
FIG. 1 schematically shows as an example the image forming apparatus of the present invention.

The yellow developing agent of the present invention comprises a binder resin, a wax and toner particles containing a yellow coloring material. The binder resin contains mainly a copolymer between a norbornene derivative and an ethylene derivative. The wax consists essentially of a natural wax. Further, the yellow coloring material contains mainly benzimidazolone.

The copolymer between a norbornene derivative and an ethylene derivative, which is used in the present invention, is represented by structural formula (1) given below:

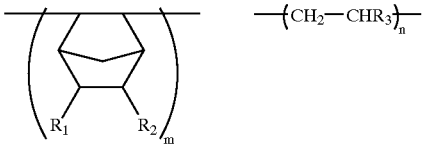

(1)

where each of R1, R2, and R3 represent an alkyl group or a hydrogen atom.

As apparent from the structural formula (1) given above, in the norbornene derivative-ethylene derivative copolymer used in the present invention, each of the norbornene derivative portion and the ethylene derivative portion forms a block and these blocks collectively form a block copolymer. It is possible to control the thermal characteristics of the copolymer by changing the ratio of the amounts, the length and the molecular weight distribution of the blocks.

The norbornene derivative-ethylene derivative copolymer used in the present invention does not have a polar group and tend to assume an amorphous structure and, thus, the light transmittance of the resin is high. Also, the copolymer, which does not have a polar group, is low in hygroscopicity, and is featured in that the copolymer exhibits stable characteristics even under the charged environment and the life.

However, the norbornene derivative-ethylene derivative copolymer is weak in affinity with paper, and the molecular agglomeration force of the copolymer is weak, with the result that offset tends to take place in the copolymer.

In the present invention, a natural wax is added to the binder resin in order to make up for the insufficient affinity with paper and to improve the resistance to the offset characteristics. The present inventors have conducted an extensive research in an attempt to find a wax exhibiting a suitable dispersion capability in the norbornene derivative-ethylene derivative copolymer, having the viscosity sufficiently lowered even under a relatively low temperature, e.g., 70° C. to 120° C., and exhibiting a satisfactory mold release characteristics from the heat roller. Since the copolymer resin is low in polarity and includes an alkyl chain, polypropylene, polyethylene and the nonpolar wax such as a paraffin wax have an excessively high affinity with the copolymer resin used in the present invention and, thus, the diameter of dispersion of the wax is rendered excessively small, resulting in failure to improve sufficiently the resistance to the offset characteristics. Such being the situation, the present inventors have continued an additional research on the wax having a suitable polarity and having a low melting point so as to find that it is effective to use an alkyl ester wax or a natural wax. Particularly, it has been found that a rice wax produces a prominent effect.

The rice wax has a melting point of about 80° C. and has a low melt viscosity at 100° C. Since the rice wax is promptly melted by the heat roller so as to be rendered oily, the rice wax is considered to be effective for improving the resistance to the offset characteristics.

Rice wax, which is one of the natural waxes, contains an alkyl ester as a main component. The higher fatty acids constituting the alkyl ester of the rice wax mainly include lignocerin acid, which is a substantially linear saturated fatty acid having 24 carbon atoms, and behenic acid having 22 carbon atoms. On the other hand, a major portion of the higher alcohols constituting the alkyl ester of the rice wax have an even number of carbon atoms ranging between 24 carbon atoms and 34 carbon atoms. Particularly, it is desirable in the present invention to use a rice wax refined to contain lignocerin acid having 24 carbon atoms as the fatty acid constituting the ester and refined for lignocerin acid to be contained in an amount of at least 60 mol % based on the total amount of the fatty acid. In the case of using the particular rice wax, the resistance to the offset characteristics tends to be further improved. Such being the situation, it is considered reasonable to understand that, if the rice wax has carbon atoms the number of which falls within a relatively small range and has a high crystallinity, the rice wax contributes to the improvement in the resistance to the offset characteristics and to the improvement in the glossiness.

The rice wax is dispersed by kneading in a reasonable particle diameter of about 1 to 2 $\mu$m in the norbornene derivative-ethylene derivative copolymer. In the present invention, it has been found that it is possible to obtain a high transparency and a high resistance to the offset characteristics by combining the particular copolymer with a suitable wax, and that the presence of the rice wax permits improving the fixing properties and dispersion properties of the yellow pigment.

The wax addition amount falls within a range of between 1 and 15% by weight, preferably between 2 and 10% by weight, based on the amount of the binder resin. If the wax addition amount is smaller than 1% by weight, it is impossible to obtain a sufficient effect of preventing the offset problem. On the other hand, if the wax addition amount exceeds 15% by weight, the transparency is rendered poor and, further, the thermal storage characteristics of the developing agent are rendered poor. As a result, the dispersion is rendered insufficient so as to tend to deteriorate the life characteristics such as the insufficient cleaning and the reduction in the image concentration.

The wax can be added in, for example, the kneading step of the binder resin and the coloring material included in the manufacturing process of the developing agent. Alternatively, it is possible to add 0.5 to 5% by weight of the rice wax or another alkyl ester wax in the polymerizing step of the norbornene derivative-ethylene derivative copolymer, followed by further adding the wax in the kneading step of the binder resin and the coloring material.

It is possible to disperse the wax in a more uniform particle size distribution by allowing a part of the wax to be present in the polymerizing step in place of adding all the wax in the kneading step alone. As a result, it is possible to further improve the offset characteristics, the transparency and the life characteristics.

The benzimidazolone pigment used in the present invention as a yellow pigment is what is obtained by introducing a heterocyclic structure into an insoluble azo pigment. The benzimidazolone pigments used in the present invention includes for example, pigment yellow 120, pigment yellow 151, pigment yellow 154, pigment yellow 175, pigment yellow 180, and pigment yellow 181. Among these benzimidazolone pigments, pigment yellow 180 has a structural formula (2) given below:

As apparent from structural formula (2), pigment yellow 180 includes two benzimidazolone structures that are bonded to each other and is excellent in the coloring power, weatherability and dispersion capability. Also, the charging properties of pigment yellow 180 are not so strong, and pigment 180 is advantageous in that the fluctuation depending on the environment is small.

On the other hand, the benzidine yellow such as pigment yellow 17, which was widely used in the past, exhibits a strong coloring power and is stable in various characteristics. However, since the decomposed material of benzidine yellow is harmful to the human body, benzidine yellow has ceased to be used. Also, monoazo yellow pigment has a low molecular weight and, thus, is poor in weatherability and gives rise to the problem that the pigment oozes out and is migrated. Further, the condensed azo pigment is insufficient in terms of the coloring power, the transparency and dispersibility.

The present inventors have conducted an experiment in which each of benzimidazolone pigment and other pigments noted above was dispersed in the norbornene derivative-ethylene derivative copolymer so as to examine the coloring power, transparency, dispersibility and stability of the charging. It has been found that the best result has been obtained in the case of using the benzimidazolone pigment.

It is desirable for the benzimidazolone pigment to be added to the binder resin in an amount of 2% by weight to 8% by weight. If the addition amount is smaller than 2% by weight, the coloring power is weak, resulting in failure achieve a sufficient color development. On the other hand, if the addition amount of benzimidazolone exceeds 8% by weight, the charging properties are rendered excessively strong or the hygroscopicity tends to be strong.

It is possible to add further additives such as a charge control agent, a lubricant, a cleaning aid, and a fluidizing agent, as required, to the developing agent of the present invention. The additives can be added in the step of preparing the toner particles and can be added to the prepared toner particles.

The additives mixed with the toner particles include, for example, metal oxides such as silica, titanium oxide, and alumina; metal oxides having the surface treated with an organic substance such as a silane coupling agent or a silicone oil; inorganic powders such as a metal soap of, for example, zinc stearate, barium titanate and strontium titanate; and organic powders such as PMMA, silicone resin, PTFE and polyvinylidene fluoride.

The developing agent of the present invention can be prepared by, for example, a pulverizing method. In the pulverizing method, toner particles are obtained by the kneading step of a molten material under heat after the preliminary mixing of the toner particle raw materials including the coloring material, the binder resin and the wax, the step of drying and pulverizing the resultant kneaded material, and the step of classifying the resultant pulverized material.

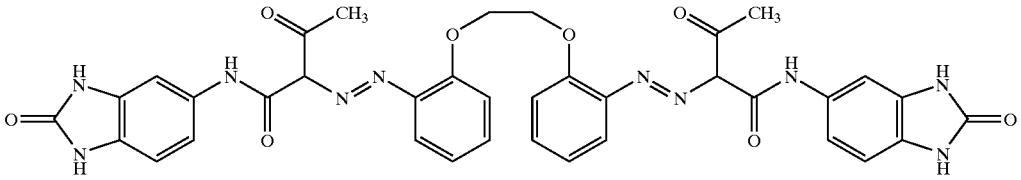

(2)

As described previously, it is possible to mix a part of the wax in the polymerizing step of the binder resin and to add the remaining wax in the kneading step of the molten material.

Also, the coloring material can be added to, for example, a part of the binder resin for preparing a master batch by melting and kneading the mixture. Toner particles can be obtained by heating, melting and kneading the toner particle raw materials containing the master batch, the remainder of the binder resin and the wax, followed by pulverizing the kneaded mass and subsequently classifying the pulverized material.

It is possible to add the additives noted above, as required, to the toner particles thus prepared. Also, it is possible to mix a carrier with the toner so as to prepare a developing agent of a two component system.

The present invention also provides a full color image forming apparatus comprising at least one image carrier, a plurality of developing devices each arranged to face the image carrier, and a fixing device.

It is possible for the full color image forming apparatus of the present invention to comprise four developing devices each housing, for example, yellow, magenta, cyan and black developing agents. In the present invention, the yellow developing agent comprising the norbornene derivative-ethylene derivative copolymer, the natural wax and the benzimidazolone pigment is housed in one of the four developing devices.

FIG. 1 schematically shows the construction of an example of the full color image forming apparatus of the present invention.

As shown in FIG. 1, the full color image forming apparatus of the present invention comprises a photoreceptor drum 1*a*, which constitutes an image carrier. The photoreceptor drum 1*a* is a cylindrical lamination type organic photoreceptor having a diameter of, for example, 40 mm and a length of, for example 266 mm. As shown in the drawing, the photoreceptor drum 1*a* is mounted rotatable in the direction denoted by an arrow.

Various devices are arranged around the photo-receptor drum 1*a* in the rotating direction of the photoreceptor drum 1*a*. Specifically, a charging roller S*a* formed of an electrical conductive rubber and serving to uniformly charge the photoreceptor drum 1*a* is arranged in contact with the surface of the photoreceptor drum 1*a*. A light exposure section 7*a* allowing the charged photoreceptor drum 1*a* to be exposed to light for forming an electrostatic latent image on the surface of the photoreceptor drum 1*a* is arranged downstream of the charging roller 5*a* in the rotating direction of the photoreceptor drum 1*a*. Also, a developing device 9*a* housing a developing agent and serving to develop the electrostatic latent image formed on the surface of the photoreceptor drum 1*a* with the developing agent is arranged downstream of the light exposure section 7*a* in the rotating direction of the photoreceptor drum 1*a*. A yellow developing agent comprising a binder resin containing mainly a norbornene derivative-ethylene derivative copolymer, a natural wax, ad a yellow pigment containing mainly a benzimidazolone pigment is housed in the developing device 9*a*.

A transfer means 11 for transferring a paper sheet P, which is a recording material, is arranged downstream of the developing device 9*a* in the rotating direction of the photoreceptor drum 1*a*. The transfer means 11 will be described herein later.

Further, a blade cleaning device 17*a* and a destaticizer lamp 19*a* are arranged downstream of the contact point between the photoreceptor drum 1*a* and the paper sheet P in the rotating direction of the photoreceptor drum 1*a*. The blade cleaning device 17*a* serves to scratch off the developing agent remaining on the surface of the photoreceptor drum 1*a* after transfer of the developing agent described herein later. Also, the destaticizing lamp 19*a* is formed of a tungsten lamp serving to destaticize the surface of the photoreceptor drum 1*a* after the transfer step. One cycle of the image formation is finished by the destaticization achieved by the destaticizing lamp 19*a*. In performing the next image formation, the uncharged photoreceptor drum 1*a* is charged again by the charging roller 5*a*.

The transfer means 11 has a width substantially equal to the drum width of the photoreceptor drum 1*a*. As shown in, for example, FIG. 1, the transfer means 11 is in the form of an endless belt. A tension roller 13 and a driving roller 15 are arranged in the annular portions in the upstream side and the downstream side of the transfer means 11. The transfer means 11 is in contact with the tension roller 13 and the driving roller 15 in the annular portions along the outer circumferential surfaces of the tension roller 13 and the driving roller 15. Incidentally, the distance between the tension roller 13 and the driving roller 15 is about 300 mm. As shown in FIG. 1, the tension roller 11 and the driving roller 15 are arranged rotatable in the directions denoted by arrows i and j, respectively. In accordance with rotation of the driving roller 15, the transfer means 11 is transferred in the direction denoted by an arrow e. The transfer speed is controlled to be equal to the rotating speed of the photoreceptor.

The endless belt used as the transfer means is required to perform two functions, i.e., the function of transferring the recording material and the function of transferring the developing agent. In this specification, the endless belt is simply called a transfer belt. The transfer belt has a width of, for example, 270 mm, a diameter of, for example, 80 mm, and a thickness of, for example, 100 $\mu$m.

As shown in FIG. 1, a paper feeding cassette 25 housing paper sheets P is arranged in the vicinity of the transfer means 11. A pick-up roller 27 for picking up the paper sheets P one by one is mounted to the paper feeding cassette 25. As shown in the drawing, the pick-up roller 27 is arranged rotatable in the direction denoted by an arrow f. A pair of resist rollers 29 consisting of an upper roller and a lower roller are arranged in front of the transfer means 11 in the transfer direction of the paper sheet P taken up by the pick-up roller 27. The paired resist rollers 29 serve to transfer the received paper sheet P to the transfer means 11 at the timing that the tip of the developing agent image formed on the photoreceptor drum la is aligned with the tip of the paper sheet P.

The paper sheet P transferred from the paired resist rollers 29 is transferred to a suction roller 24 abutting against the tension roller 13 with the transfer means 11 interposed therebetween. The suction roller 24 is electrically connected to the ground. A metal roller having a diameter of, for example, 6 mm and made of SUS is used as the suction roller 24. It is also possible to use a conductive rubber roller made of, for example, an urethane rubber having carbon particles dispersed therein in place of the metal roller. Further, it is possible to use a conductive brush or a corona charger in place of the suction roller 24.

Voltage is applied from a power source 41 to the suction roller 24. Specifically, voltage of 1.5 kV is applied from the power source 41 to the suction roller 24. With increase in the voltage applied to the suction roller 24, the amount of the electric charge imparted to the belt is increased so as to increase the suction force. However, in view of the limit in respect of the resistance of the belt material to the voltage, the highest voltage applied to the suction roller is about 3 kV.

The suction roller 24 is rotated in the direction conforming with the transfer direction of the endless belt or the paper sheet P. At the time when the paper sheet P is transferred to the suction roller portion, a suction bias is applied to the suction roller 24. As a result, the surface of the paper sheet P is charged negative, and the opposite side of the endless belt in contact with the tension roller 13 is charged positive. As a result, the paper sheet P is sucked by the endless belt 11 by the resultant electrostatic force.

As described above, a first process unit 100*a* is formed of the photoreceptor drum 1*a*, the charging roller 5*a*, the light exposure section 7*a*, the developing device 9*a*, the blade cleaning device 17*a* and the destaticizing lamp 19*a*.

Arranged on the transfer means 11 in the transfer direction between the tension roller 13 and the driving roller 15 are a second process unit 100*b* for performing a magenta development, a third process unit 100*c* for performing a cyan development, and a fourth process unit 100*d* for performing a black development in addition to the first process unit 100*a* for performing a yellow development referred to above. The process units 100*a*, 100*b*, 100*c* and 100*d* noted above are collectively referred to herein later as a process unit 100. Each of the process unit 100*b*, the process unit 100*c* and the process unit 100*d* is equal in construction to the process unit 100*a* for performing the yellow development. To be more specific, a photoreceptor drum 1*b*, a photoreceptor drum 1*c*, and a photoreceptor drum 1*d* are arranged in substantially the centers of the process units 100*b*, the process unit 100*c* and the process unit 100*d*, respectively. The photoreceptor drums 1*a*, 1*b*, 1*c* and 1*d* are collectively called herein later the photoreceptor drum 1. A charging roller 5*b*, a charging roller 5*c*, and a charging roller 5*d* (the charging rollers 5*a*, 5*b*, 5*c* and 5*d* being collectively called herein later as the charging roller 5) are arranged to face the photoreceptor drums 1, respectively.

A light exposure section 7*b*, a light exposure section 7*c* and a light exposure section 7*c* (the light exposure section 7*a*, the light exposure section 7*b*, the light exposure section 7*c* and the light exposure section 7*d* being herein later referred to as the light exposure section 1) are arranged downstream of the charging rollers 5, respectively, in the rotating direction of the photoreceptor rollers 1. Further, a developing device 9*b*, a developing device 9*c*, and a developing device 9*d* (the developing devices 9*a*, 9*b*, 9*c* and 9*d* being herein later referred to as the developing device 9), a blade cleaning device 17*b*, a blade cleaning device 17*c*, and a blade cleaning device 17*d* (the blade cleaning devices 17*a*, 17*b*, 17*c* and 17*d* being herein later referred to as the blade cleaning device 17), and a destaticizing lamp 19*b*, a destaticizing lam 19*c* and a destaticizing lamp 19*d* (the destaticizing lamps 19*a*, 19*b*, 19*c* and 19*d* being herein later referred to as the destaticizing lamp 19), are arranged respectively, like the process unit 100*a* described above. It should be noted, however, the developing agents housed in the developing devices 9*a*, 9*b*, 9*c* and 9*d* are different from each other. To be more specific, a first developing agent of yellow according to the present invention is housed in the developing device 9*a* of the process unit 100*a*. A second developing agent of magenta is housed in the developing device 9*b* of the process unit 100*b*. A third developing agent of cyan is housed in the developing device 9*c* of the process unit 100*c*. Further, a fourth developing agent of black is housed in the developing device 9*d* of the process unit 100*d*.

In outputting a color image, the paper sheet P transferred by the transfer means 11 is successively brought into contact with each of the photoreceptor drums 1. In the abutting position of the paper sheet P with each of the photoreceptor drums 1, a transfer means, i.e., a power feeding roller 23*a*, a power feeding roller 23*b*, a power feeding roller 23*c* and a power feeding roller 23*d* (the power feeding rollers 23*a*, 23*b*, 23*c* and 23*d* being herein later referred to as the power feeding roller 23), is arranged in a 1:1 relationship with and opposed to the photoreceptor drum 1. The power feeding roller 23 is arranged in the abutting position of the transfer means 11 against the corresponding photoreceptor drum 1 such that the back surface of the power feeding roller 23 is in contact with the transfer means 11 and is allowed to face the photoreceptor drum 1 with the transfer means 11 interposed therebetween.

The image forming process of the image forming apparatus constructed as described above will now be described. It should be noted that the rotating photoreceptor drums 1 included in the four process units are uniformly charged to about −500 V by the contact charging rollers 5 to which are applied AC-superposed DC bias.

The photoreceptor drums 1 uniformly charged by the charging rollers 5 are selectively irradiated with light emitted from the light exposure sections 7 each formed of a solid state scanning head for performing a light exposure by utilizing a phosphor, with the result that an electrostatic latent image is formed on the surface of each of the photoreceptor drum 1. The electrostatic latent images thus formed are developed by the developing agents of various colors that are sufficiently charged and housed in the developing devices 9.

On the other hand, the paper sheet P is taken up by the pick-up roller 27 from the paper feeding cassette 25 and, then, transferred to the paired resist rollers 29. The paired resist rollers 29 take the timing such that the tip of the paper sheet P is aligned with the tip of the developing agent image and, then, transfer the paper sheet P onto the transfer means 11.

When the paper sheet P is transferred to the transfer position of a first transfer station, a bias voltage is applied from the power feeding roller 23 to the transfer means 11. By the application of the bias voltage, a transfer electric field is formed between the photoreceptor drum 1 and the transfer means 11. It follows that the first developing agent image on the photoreceptor drum 1*a* is transferred onto the paper sheet P and, then, the paper sheet P bearing the first developing agent image is transferred to reach the photoreceptor drum 1*b*. The second developing agent image formed on the photoreceptor drum 1*b* is transferred so as to be superposed on the first developing agent image transferred previously. The paper sheet P is further transferred such that the third and fourth developing agent images are transferred from the photoreceptor drums 1*c* and 1*d* so as to be superposed on the first and second developing agent images formed previously.

The paper sheet P bearing the toner image formed by the multiple toner image transfer described above is transferred from the transfer means 11 onto a fixing device 33. The fixing device 33 comprises a heating roller 35 and a pressurizing roller 37 each covered with a fluorine-containing resin. The fixing device 33 is an oil-free fixing device to which a mold release agent such as a silicone oil is not supplied. The paper sheet P is passed through the clearance between the heating roller 35 and the pressurizing roller 37 such that the toner image formed on the paper sheet P is brought into contact with the heating roller 35, with the result that the toner image is fixed to the paper sheet P.

After the paper sheet P is moved away from the transfer means 11 (endless belt), the surface of the endless belt is cleaned by a blade cleaning device 16.

Figure 2:
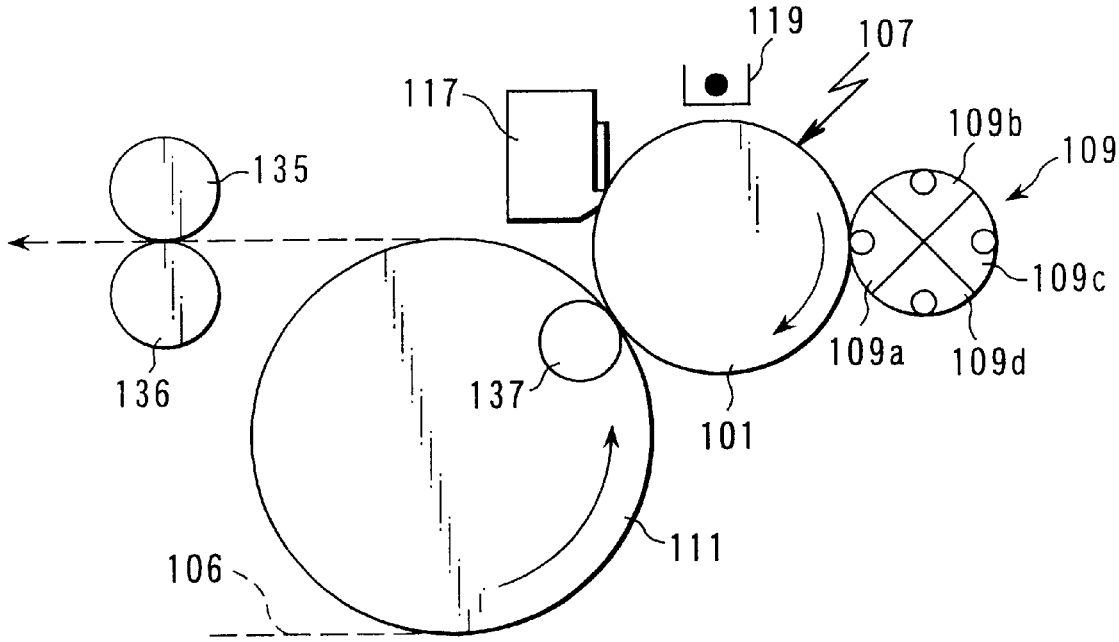
FIG. 2 schematically shows as another example the image forming apparatus of the present invention.

FIG. 2 schematically shows another example of the image forming apparatus of the present invention.

As shown in the drawing, the image forming apparatus comprises a photoreceptor drum 101 acting as an image carrier. The photoreceptor drum 101 is formed of a cylindrical lamination type organic photoreceptor having a diameter of, for example, 40 mm and a length of 266 mm. As shown in the drawing, the photoreceptor drum 101 is arranged rotatable in a direction denoted by an arrow.

Various devices are arranged around the photoreceptor drum 101 apart from each other in the rotating direction of the photoreceptor drum 101.

Specifically, a developing device 109 housing developing agents and serving to develop the electrostatic latent image formed by a light exposure section 107 with the developing agents is arranged to face the photoreceptor drum 101. A transfer means 111, which is, for example, roller-like, is arranged downstream of the developing device 9 in the rotating direction of the photoreceptor drum 101. The roller-like transfer means 111, which serves to transfer a paper sheet used as a recording medium so as to have the developing agent image formed on the surface of the photoreceptor drum 101 transferred thereonto, is arranged rotatable in synchronism with the photoreceptor drum 101. A blade cleaning device 117 and a destaticizing lamp 119 are arranged downstream of the roller-like transfer means 111 in the rotating direction of the photoreceptor drum 101. The blade cleaning device 117 serves to scratch off the developing agent remaining on the photoreceptor drum 101 after transfer of the developing agent image by the blade (not shown). On the other hand, the destaticizing lam 119 is formed of a tungsten lamp serving to destaticize optically the surface of the photoreceptor drum 101 after transfer of the developing agent image. One cycle of the image formation is finished by the destaticization performed by the destaticizing lamp 119. When a next image is formed, the uncharged photoreceptor drum 101 is charged again.

A paper feeding cassette (not shown) housing paper sheets is arranged in the vicinity of the transfer means 111. A paper sheet is transferred from the paper feeding cassette in the direction denoted by an arrow so as to be fed into the clearance between the photoreceptor drum 101 and the transfer means 111.

The developing device 109 is partitioned into four sections so as to form a first developing section 109*a*, a second developing section 109*b*, a third developing section 109*c* and a fourth developing section 109*d*. The developing device 9 is arranged rotatable such that the first developing section 109*a*, the second developing section 109*b*, the third developing section 109*c* and the fourth developing section 109*d* are successively brought into the position facing the photoreceptor drum 101. A first developing agent, a second developing agent, a third developing agent and a fourth developing agent are housed in the first developing section 109*a*, the second developing section 109*b*, the third developing section 109*c* and the fourth developing section 109*d*, respectively, as in the apparatus shown in FIG. 1.

In the image forming apparatus of the construction shown in FIG. 2, an image formation is carried out as follows.

In the first step, a bias voltage is applied to the photoreceptor drum 101 by a charging means (not shown) so as to charge uniformly the photoreceptor drum 101. Then, a first electrostatic latent image is formed on the photoreceptor drum 101 by means of a light irradiation 107. Further, the first developing section 109*a* is positioned to face the first electrostatic latent image, and the first developing agent is supplied onto the surface of the photoreceptor drum 101 so as to form a first developing agent image.

When the paper sheet is transferred to the transfer position, a bias voltage is applied from a power feeding means 137 to the transfer means 111. By the application of the bias voltage, a transfer electric field is formed between the photoreceptor drum 101 and the transfer means 111. Under this condition, the first developing agent image formed on the photoreceptor drum 101 is transferred onto the paper sheet.

In the next step, the first developing agent and the charge remaining on the photoreceptor drum 101 are removed by the cleaning device 117 and the destaticizing means 119, respectively.

Then, a second electrostatic latent image is formed by the light irradiation 107 on the surface of the photoreceptor drum 101 having the residual first developing agent and the charge removed therefrom. Also, the developing device 101 is rotated by one fourth of the one complete rotation so as to permit the second developing section 109*b* to face the photoreceptor drum 101.

Under this condition, a second developing agent is supplied onto the second electrostatic latent image so as to form a second developing agent image, followed by applying again a bias voltage from the power feeding means 137 to the transfer means 111 so as to form a transfer electric field between the photoreceptor drum 101 and the transfer means 111. As a result, the second developing agent image formed on the photoreceptor drum 101 is transferred onto the paper sheet having the first developing agent image transferred thereto previously.

The process described above is repeated for each of the third developing agent and the fourth developing agent so as to form laminated layers of the first to fourth developing agent images.

The paper sheet P bearing the developing agent image formed by the multi-stage transfer is transferred in the direction denoted by an arrow 106 so as to be fed into an oil-free fixing device comprising a heating roller 135 and a pressurizing roller 136 each covered with a fluorine-containing resin. The paper sheet P is passed through the clearance between the heating roller 135 and the pressurizing roller 136 such that the developing agent image formed on the paper sheet P is brought into contact with the heating roller 135, with the result that the developing agent image is fixed to the paper sheet P.

The image forming apparatus shown in each of FIGS. 1 and 2 permits forming a satisfactory developing agent image.

Some Examples of the present invention will now be presented for describing more in detail the present invention.

EXAMPLE 1

Prepared as a binder resin was TOPAS-TM (trade name of a norbornene-ethylene copolymer resin manufactured by Ticona Inc.). The norbornene-ethylene copolymer resin had a number average molecular weight Mn of 2,500, a weight average molecular weight Mw of 5,000, a glass transition temperature of 60° C., and a softening point of 100° C.

Preparation of Master Batch

Composition of Master Batch Materials

Binder Resin

Norbornene-ethylene copolymer resin . . . 70 parts by weight

Benzimidazolone Pigment

Pigment yellow 180 . . . 30 parts by weight

The master batch materials given above were kneaded by a pressurizing kneader, followed by passing the kneaded mass through a twin roll so as to prepare a master batch of a yellow pigment.

Preparation of Toner Particles

Composition of Toner Particle Materials

Prepared master batch . . . 20 parts by weight

Binder resin (norbornene-ethylene copolymer resin . . . 74 parts by weight

Rice wax LAX-N-100A (manufactured by NS Chemical Inc., having a melting point of 79° C. and kinetic viscosity at 100° C. of 18 cSt) . . . 5 parts by weight Charge controller (TN-105, trade name of salicylic acid derivative zirconium complex manufactured by Hodogaya Kagaku K.K.) . . . 1 part by weight The toner particle materials given above preliminarily mixed uniformly by a Henschel mixer, followed by kneading the preliminary mixture by using a biaxial extruder PCM45 so as to obtain a kneaded mass. The kneaded mass thus obtained was cooled and, then, roughly pulverized so as to obtain roughly pulverized particles. The roughly pulverized particles thus obtained were finely pulverized by a jet pulverizing machine, and the fine powder was cut by an air stream classifying machine so as to obtain yellow toner particles having a particle diameter of 8.0 $\mu$m in 50% by volume of the yellow toner particles.

The yellow toner particles thus obtained were dispersed in an epoxy resin and the resultant mixture was sliced by a super microtome. Under this condition, the particle diameter of the dispersed wax was examined by a transmission electron microscope, finding that the average particle diameter of the dispersed wax particles was 2 $\mu$m.

Further, a desired negatively charged toner for a developing agent of a two component system was obtained by mixing for three minutes in a Henschel mixer the raw materials comprising 100 parts by weight of the yellow toner rioted above, 2 parts by weight of NAX50 (trade name of a fine hydrophobic silica powder manufactured by Nippon Aerosil K.K. and having a specific surface area of 40 $m^2/g$ as measured by a BET method), 1 part by weight of STT-30A (trade name of a titanium oxide fine powder manufactured by Titan Kogyo K.K.) and 0.5 part by weight of zinc stearate having a particle diameter of 4 $\mu$m, followed by sieving the mixture with a sieve of 200 meshes.

Then, the toner thus obtained was mixed with EFCS1-60 (trade name of a carrier manufactured by Powder Tec Inc. and having an average particle diameter of 60 $\mu$m and a maximum magnetization of 64 emu/g at a toner ratio concentration of 5.5% so as to obtain a developing agent of a two component system.

The developing agent of the two component system thus obtained was used in FC-22 (trade name of a digital full color copying machine manufactured by Toshiba Tec K.K.) so as to form a yellow toner image. It was possible to obtain a clear yellow toner image.

Also, the yellow toner image was formed on an OHP so as to measure the transmittance. The transmittance was found to be satisfactory, i.e., 75%. Also, the non-offset temperature region, which was measured by using a paper sheet of 80 g under the condition that the thickness of the toner layer was 1.6 $mg/cm^2$, was found to fall within a practical range of between 140° C. and 170° C.

Further, a copying test was conducted on 60,000 paper sheets. The developing agent image was found to be satisfactory in both the image density and the fogging. Also, scattering of the toner was not recognized. It was also possible to obtain a satisfactory developing agent image free from deteriorating in the half tone without giving rise to the filming on the photoreceptor. Further, where the evaluation was performed under a high humidity environment, the problems such as the degradation of the image quality such as fogging and the scattering of the toner were not recognized at all.

On the other hand, the prepared developing agent was put in a polyethylene bag, and the bag was put in a constant temperature water bath maintained at 55° C. for 8 hours so as to examine the life characteristics of the developing agent, i.e., the agglomeration and the thermal storage characteristics of the developing agent. The toner agglomeration was scarcely observed, and the thermal storage characteristics of the developing agent were found to be satisfactory. Table 1 shows the results of the tests.

The OHP transmittance shown in Table 1 was measured by using an absorptiometer. The mark ◎ shown in Table 1denotes "excellent", indicating that the OHP transmittance was not lower than 77%. The mark ○ shown in Table 1 denotes "good", indicating that the OHP transmittance was not lower than 74% and lower than 77%. The mark Δ shown in Table 1 denotes "somewhat poor", indicating that the OHP transmittance was not lower than 70% and lower than 74%. Further, the mark X shown in Table 1 denotes "poor", indicating that the OHP transmittance was lower than 70%.

The resistance to the offset properties shown in Table 1 was measured on the basis of the non-offset temperature width with a toner layer thickness of 1.6 $mg/cm^2$ by conducting a fixing test using FC-22 manufactured by Toshiba Tec K.K. The mark ◎ shown in Table 1 denotes that the temperature width was not smaller than 50° C. The mark ○ shown in Table 1 denotes that the temperature width fell within a range of between 30° C. and 50° C. The mark Δ shown in Table 1 denotes that the temperature width fell within a range of between 20° C. and 30° C. Further, the mark X shown in Table 1 denotes that the temperature width was smaller than 20° C.

For measuring the resistance to the environment shown in Table 1, a developing agent was prepared and used in a copying machine FC-22 manufactured by Toshiba Tec K.K. Then, the resistance to the environment was measured on the basis of the developing agent image after the developing agent image thus formed was left to stand for 12 hours under an environment of 30° C. and a relative humidity of 85%. The mark ○ shown in Table 1 denotes that the image quality was scarcely changed under the ordinary temperature and ordinary humidity. The mark Δ shown in Table 1 denotes that, although there was an increase in the fogging, the increase in the fogging was within a standard of 1.5% or less. Further, the mark X shown in Table 1 denotes that the image quality failed to fall within the standard.

Further, the life characteristics is based on the image quality after the copying test on 60,000 paper sheets. The mark ○ denotes that the image characteristics such as ID and fogging maintained substantially the initial state. The mark Δ denotes that, although deterioration was recognized, the change in ID was smaller than 0.2 and the fogging was lower than 1.5%. Further, the mark X denotes that the image quality was changed to fail to fall within an acceptable range.

EXAMPLE 2

Yellow toner particles were obtained as in Example 1, except that a norbornene-ethylene copolymer resin having 1% of rice wax added in the polymerizing step was used in place of the norbornene-ethylene copolymer resin used in Example 1. The average particle diameter of the dispersed wax was 1.5 $\mu$m.

A developing agent of the two component system was prepared as in Example 1 by using the toner particles thus obtained.

A developing agent was formed as in Example 1 by using the developing agent of the two component system thus obtained, and the developing agent thus formed was evaluated. It was possible to obtain a clear yellow developing agent image.

Also, a developing agent image was formed on an OHP so as to measure the transmittance. The transmittance was found to be 77%, which was satisfactory.

Further, the non-offset temperature region was measured by using a paper sheet of 80 g under the condition that the thickness of the toner layer was 1.6 mg/cm$^2$, with the result that the non-offset temperature region was found to fall within a broad range of between 130° C. and 180° C.

Further, a copying test was conducted on 60,000 paper sheets. The developing agent image was found to be satisfactory in both the image density and the fogging. Also, scattering of the toner was found to be satisfactory. It was also possible to obtain a satisfactory developing agent image free from scratching in the half tone without giving rise to the filming on the photoreceptor. Further, where the evaluation was performed under a high humidity environment, the problems such as the degradation of the image quality such as fogging and the scattering of the toner were not recognized at all.

On the other hand, the prepared developing agent was put in a polyethylene bag, and the bag was put in a constant temperature water bath maintained at 55° C. for 8 hours. The toner agglomeration was scarcely observed, and the thermal storage characteristics of the developing agent were found to be satisfactory. Table 1 also shows the results of the tests.

EXAMPLE 3

Yellow toner particles were obtained as in Example 1, except that the amount of the wax was set at 8% by weight. The average particle diameter of the dispersed wax was found to be 2.0 $\mu$m.

A developing agent of the two component system was prepared as in Example 1 by using the toner particles thus obtained.

A developing agent was formed as in Example 1 by using the developing agent of the two component system thus obtained, and the developing agent thus formed was evaluated as in Example 1. It was possible to obtain a clear yellow developing agent image.

Also, a developing agent image was formed on an OHP so as to measure the transmittance. The transmittance was found to be somewhat lowered to 73%, though the transmittance thus obtained was within a practical range. Further, the non-offset temperature region was measured by using a paper sheet of 80 g under the condition that the thickness of the toner layer was 1.6 mg/cm$^2$, with the result that the non-offset, temperature region was found to fall within a range of between 130° C. and 170° C.

Further, a copying test was conducted on 60,000 paper sheets. The developing agent image was found to be satisfactory in both the image density and the fogging. Also, scattering of the toner was not recognized. It was also possible to obtain a satisfactory developing agent image free from deteriorating in the half tone. Although the filming on the photoreceptor was slightly observed, the filming was not on a level of generating a problem that the filming appears on the developing agent image. Further, where the evaluation was performed under a high humidity environment, the problems such as the degradation of the image quality such as fogging and the scattering of the toner were not recognized at all.

On the other hand, the prepared developing agent was put in a polyethylene bag, and the bag was put in a constant temperature water bath maintained at 55° C. for 8 hours. The toner agglomeration was scarcely observed, and the thermal storage characteristics of the developing agent were found to be satisfactory. Table 1 also shows the results of the tests.

COMPARATIVE EXAMPLE 1

Yellow toner particles were obtained as in Example 1, except that a polyester resin having a weight average molecular weight Mw of 13,000, a number average molecular weight Mn of 3,000, a glass transition point Tg of 63° C. and a softening point of 106° C. was used in place of the norbornene-ethylene copolymer resin used in Example 1. The average particle diameter of the dispersed wax was 2.0 $\mu$m.

A developing agent of the two component system was prepared by using the toner particles thus obtained.

A developing agent was formed as in Example 1 by using the developing agent of the two component system thus obtained, and the developing agent thus formed was evaluated as in Example 1. It was possible to obtain a clear yellow developing agent image.

Also, a developing agent image was formed on an OHP so as to measure the transmittance. The transmittance was found to be lowered to 72%, which was not sufficiently satisfactory. Further, the non-offset temperature region was measured by using a paper sheet of 80 g under the condition that the thickness of the toner layer was 1.6 mg/cm$^2$, with the result that the non-offset temperature region was found to fall within a broad range of between 140° C. and 170° C., which was substantially equal to the range in the Examples of the present invention described previously.

Further, a copying test was conducted on 60,000 paper sheets. The developing agent image was found to be satisfactory in both the image density and the fogging. Also, scattering of the toner was not recognized. It was also possible to obtain a satisfactory developing agent image free from deteriorating in the half tone without giving rise to the filming on the photoreceptor. Further, where the evaluation was performed under a high humidity environment, observed were a slight occurrence of fogging accompanying the decrease in the charged amount and the change of the developing agent image toward the high $\gamma$-characteristics. On the other hand, the scattering of the toner were not recognized.

Further, the prepared developing agent was put in a polyethylene bag, and the bag was put in a constant temperature water bath maintained at 55° C. for 8 hours. The toner agglomeration was scarcely observed, and the thermal storage characteristics of the developing agent were found to be satisfactory. Table 1 also shows the results of the tests.

COMPARATIVE EXAMPLE 2

Yellow toner particles were obtained as in Example 1, except that pigment yellow 97, which is an monoazo pigment, was used in place of the benzimidazolone pigment, and that the master batch materials were set to comprise 30 parts by weight of pigment yellow 97 and 64 parts by weight of norbornene-ethylene copolymer resin in order combine the coloring power of pigment yellow 97 to the coloring power of pigment yellow 180. The average particle diameter of the dispersed wax was 2.0 $\mu$m.

A developing agent of the two component system was prepared by using the toner particles thus obtained.

A developing agent was formed as in Example 1 by using the developing agent of the two component system thus obtained, and the developing agent thus formed was evaluated as in Example 1. It was possible to obtain a clear yellow developing agent image.

Also, a developing agent image was formed on an OHP so as to measure the transmittance. The transmittance was found to be considerably lowered to 66%, failing to fall within a practical range. Further, the non-offset temperature region was measured by using a paper sheet of 80 g under the condition that the thickness of the toner layer was 1.6 mg/cm$^2$, with the result that the non-offset temperature region was found to fall within a range of between 140° C. and 170° C., which was substantially equal to the range in the Examples of the present invention described previously.

Further, a copying test was conducted on 60,000 paper sheets. The developing agent image was found to be satisfactory in the image density. However, the developing agent image was not satisfactory in the fogging and the scattering of the toner. Also, the developing agent image was found to be free from scratching in the half tone and free from the filming on the photoreceptor. Further, where the evaluation was performed under a high humidity environment, observed were a slight occurrence of fogging accompanying the decrease in the charged amount and the change of the developing agent image toward the high γ-characteristics. On the other hand, the scattering of the toner were not recognized.

Further, the prepared developing agent was put in a polyethylene bag, and the bag was put in a constant temperature water bath maintained at 55° C. for 8 hours. The toner agglomeration was scarcely observed, and the thermal storage characteristics of the developing agent were found to be satisfactory. Table 1 also shows the results of the tests.

COMPARATIVE EXAMPLE 3

Yellow toner particles were obtained as in Example 1, except that a paraffin wax was used in place of the rice wax used in Example 1. The average particle diameter of the dispersed wax was found to be 0.5 μm.

A developing agent of the two component system was prepared as in Example 1 by using the toner particles thus obtained.

A developing agent was formed as in Example 1 by using the developing agent of the two component system thus obtained, and the developing agent thus formed was evaluated as in Example 1. It was possible to obtain a clear yellow developing agent image.

Also, a developing agent image was formed on an OHP so as to measure the transmittance. The transmittance was found to be lowered to 74%, which was satisfactory. Further, the non-offset temperature region was measured by using a paper sheet of 80 g under the condition that the thickness of the toner layer was 1.6 mg/cm$^2$, with the result that the offset occurred over the entire temperature region.

Further, the prepared developing agent was put in a polyethylene bag, and the bag was put in a constant temperature water bath maintained at 55° C. for 8 hours. The toner agglomeration was scarcely observed, and the thermal storage characteristics of the developing agent were found to be satisfactory. Table 1 also shows the results of the tests.

TABLE 1

| | sample | OHP transmittance | resistance to offset characteristics | resistance to environment | life characteristics |
|---|---|---|---|---|---|
| Example 1 | norbornene-ethylene resin PY180 + rice wax 5% | ○ | ○ | ○ | ○ |
| Example 2 | addition of 1% rice wax in synthesizing resin for Example 1 | ◎ | ◎ | ○ | ○ |
| Example 3 | norbornene-ethylene resin PY180 + rice wax 8% | Δ | ○ | ○ | ○ |
| Comparative example 1 | polyester resin PY180 + rice wax 5% | Δ | ○ | Δ | ○ |
| Comparative example 2 | norbornene-ethylene resin PY97 + rice wax 5% | x | ○ | Δ | x |
| Comparative example 3 | norbornene-ethylene resin PY180 + rice wax 5% | ○ | x | — | — |

As apparent from, for example, Examples 1 to 3 given in Table 1, the developing agent of the present invention is excellent in the resistance to the environment and in the life characteristics. Also, it is possible to obtain a developing agent image high in transparency, excellent in the color development, and satisfactory in the offset resistance characteristics by using the developing agent of the present invention.

Also, as apparent from Examples 1 and 3 of the present invention, if the wax addition amount is simply increased in the melt kneading step of the toner particle materials, the dispersion of the wax tends to lowered, and the transparency also tends to be lowered. However, as apparent from Examples 1 and 2, if the rice wax addition is divided such that the rice wax is added partly in the polymerizing step of the binder resin and is added partly in the melt kneading step, the dispersibility of the wax is improved so as to improve the OHP transmittance, the resistance to offset, the resistance to the environment and the life characteristics.

Additional advantages and modifications will readily occur to those skilled in the art. Therefore, the present invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A yellow developing agent, comprising a binder resin containing a copolymer resin of a norbornene derivative and an ethylene derivative, a natural wax, and a yellow coloring material containing benzimidazolone pigment.

2. The yellow developing agent according to claim 1, wherein said natural wax is a rice wax.

3. The yellow developing agent according to claim 2, wherein said rice wax contains lignocerin acid having 24 carbon atoms as a fatty acid constituting the ester, said lignocerin acid being contained in an amount of at least 60% by mol based on the total molar amount of the fatty acid.

4. The yellow developing agent according to claim 1, wherein said natural wax is contained in an amount of 1 to 15% by weight based on said binder resin.

5. The yellow developing agent according to claim 2, wherein said natural wax is dispersed in said binder resin in an average particle diameter of 1 $\mu$m to 2 $\mu$m.

6. The yellow developing agent according to claim 1, wherein one part amount of said natural wax is added in the polymerizing step of said binder resin and another part amount of said natural wax is added in the melt kneading step with said yellow coloring material.

7. The yellow developing agent according to claim 1, wherein said benzimidazolone pigment is added in an amount of 2 to 8% by weight based on said binder resin.

8. A full color image forming apparatus, comprising:

at least one image carrier;

a plurality of developing devices arranged to face said image carriers; and a fixing device, wherein one of said plural developing devices houses a yellow developing agent, comprising a binder resin containing a copolymer resin of a norbornene derivative and an ethylene derivative, a natural wax, and a yellow coloring material containing benzimidazolone pigment.

9. The full color image forming apparatus according to claim 8, wherein said natural wax is a rice wax.

10. The full color image forming apparatus according to claim 9, wherein said rice wax contains lignocerin acid having 24 carbon atoms as a fatty acid constituting the ester, said lignocerin acid being contained in an amount of at least 60% by mol based on the total molar amount of the fatty acid.

11. The full color image forming apparatus according to claim 8, wherein said natural wax is contained in an amount of 1 to 15% by weight based on said binder resin.

12. The full color image forming apparatus according to claim 8, wherein said natural wax is dispersed in said binder resin in an average particle diameter of 1 $\mu$m to 2 $\mu$m.

13. The full color image forming apparatus according to claim 8, wherein one part amount of said natural wax is added in the polymerizing step of said binder resin and another amount of is added partly in the melt kneading step with said yellow coloring material.

14. The full color image forming apparatus according to claim 8, wherein said benzimidazolone pigment is added in an amount of 2 to 8% by weight based on said binder resin.

* * * * *